United States Patent [19]

Szücs et al.

[11] Patent Number: 4,796,692

[45] Date of Patent: Jan. 10, 1989

[54] CONVECTOR WITH FINNED TUBES

[75] Inventors: László Szücs; József Szabó, both of Budapest, Hungary

[73] Assignee: Energiagasdalkodasi Intezet, Budapest, Hungary

[21] Appl. No.: 932,510

[22] PCT Filed: Feb. 21, 1986

[86] PCT No.: PCT/HU86/00011

§ 371 Date: Dec. 12, 1986

§ 102(e) Date: Dec. 12, 1986

[87] PCT Pub. No.: WO86/04981

PCT Pub. Date: Aug. 28, 1986

[30] Foreign Application Priority Data

Feb. 22, 1985 [HU] Hungary ..... 675/85

[51] Int. Cl.[4] ..... F24H 9/02

[52] U.S. Cl. ..... 165/129; 165/131

[58] Field of Search ..... 165/128, 129, 131

[56] References Cited

U.S. PATENT DOCUMENTS

| | | | |
|---|---|---|---|
| 1,705,491 | 3/1929 | Murray, Jr. | 165/131 |
| 1,805,116 | 5/1931 | Trane | 165/131 X |
| 1,810,973 | 6/1931 | Luromski | 165/128 |
| 1,963,506 | 6/1934 | Schutz | 165/129 |
| 3,137,343 | 6/1964 | Varlowga | 165/129 |

FOREIGN PATENT DOCUMENTS

| | | | |
|---|---|---|---|
| 68014 | 10/1940 | Czechoslovakia | 165/131 |
| 2649770 | 5/1978 | Fed. Rep. of Germany . | |
| 153573 | 10/1966 | Hungary . | |
| 183314 | 6/1983 | Hungary . | |
| 10744 | 11/1901 | Norway | 165/128 |
| 301124 | 11/1928 | United Kingdom . | |

*Primary Examiner*—Ira S. Lazarus
*Assistant Examiner*—Richard R. Cole
*Attorney, Agent, or Firm*—Schweitzer & Cornman

[57] ABSTRACT

Convector with finned tubes [1, 2, 3, 4] for conducting a first heating medium and an upright channel [42] for a second medium around at least one of the finned tubes [1]. A lower finned tube [1], a side finned tube [2] and an upper finned tube [3] are rigidly connected in series for the first medium so that they constitute a self-supporting structure. The side finned tube [2] constitutes a first side bording element for the upright channel [42], the second side bording element is either a further side finned tube [4] rigidly connected in parallel or a stiffening side plate [60].

7 Claims, 5 Drawing Sheets

CONVECTOR WITH FINNED TUBES

TECHNICAL FIELD

The invention relates to a convector comprising at least one finned tube for conducting a heating first medium and bording elements confining an upright channel for a second medium around the finned tube.

BACKGROUND ART

Convectors containing finned tubes are mostly used for heating apartments and buildings. They are designed by taking into consideration the so-called chimney effect. The chimney effect is achieved by meass of an upright channel in which the heating tube provided with fins most of its length. The heating tube raises the temperature of the air in the channel above the temperature of the outer air, and the difference of specific densities of the cold and hot air produces an upright air flow in the channel. The quantity of heat transferred to the air flowing along the finned heating tube depends on the flow velocity, therefore the chimney effect considerably increases the heat released by the heating tube.

The aforesaid chminey effect is usually provided for by means of air-tight walls confining an upright chanel and of a heating tube or several heating tubes arranged at the bottom part of the channel. For aesthetic and hygienic reasons, the upper opening of the channel is closed by means of a grid or a similar element. Such a convector is described in the German published specification No. OS-2 649 770. The drawback of this construction consists in that the bording plates constituting the upright channel do not participate practically in the heat transfer and the grid closing the top of the channel reduces the heating power.

In another known convector flat plates provided with perforations and connected to heating tubes form practically a box. The box is roughly brick-shaped and all of its bording surfaces are provided practically equally with air-permeable perforations. In this solution no air-tightly closed bording surfaces are to be found, consequently the chimney effect is poor. Only a minimum air flow gets through the perforations of the plates so that the surplus effect related to the surplus surface is very low as compared to the above described construction of convector. These heating bodies may be considered rather free-flow radiators than convectors.

DISCLOSURE OF THE INVENTION

The object of the present invention is to achieve a finned-tube convector performing good heat engineering properties the mechanical construction of which is simple therefore it can be easily and inexpensively produced.

The invention is based upon the recognition that the upper closing grid and the bording side walls of the upright channel can be replaced at least partly by finned heating tubes the mechanical construction and aesthetic appearance of which are suitable for constituting the outer bording elements of the convector. According to the invention the finned tubes are rigidly connected to each other so that they constitute a self-supporting structure which can be simply suspended by hooks on a wall or provided with legs, to which structure a front plate and eventually a back plate can be easily fastened.

The invention is a convector comprising at least one finned tube for conducting a heating first medium and bording elements confining an upright channel for a second medium around said at least one finned tube. According to the invention the convector comprises a substantially horizontal lower finned tube, one end of which being provided with a first opening for the first medium, a substantially vertical side finned tube connected to the other end of said lower finned tube, said side finned tube constituting a first side bording element for the upright channel, a substantially horizontal upper finned tube, one end of which being connected to the upper end of said finned tube, the other end of said upper finned tube being provided with a second opening for the first medium, said lower, side and upper finned tubes constituting a path for the first medium between said first and second openings, a second side bording element between said one end of the lower finned tube and said other end of the upper finned tube, wherein the connections between said lower, side and upper finned tubes are rigid so that they constitute with said second side bording element a self-supporting structure, and a bording front plate fastened to the self-supporting structure.

In the convector according to the invention the chimney effect is essentially maintained but the grid closing the upright channel and at least one side plate are replaced by heated finned tubes along which the second medium, e.g. air can flow and warm up.

In the convector according to the invention the hot air flows upwards between the front and back bording elements, which may be either a front plate and a back plate, or a front plate and a wall. The streaming conditions are different as compared to an upright channel having completely closed bording walls. The quantity of the flowing air increases due to the increase of the flow cross-section, the flow velocity slightly decreases if no other measures are taken, and the specific surplus heating power referred to the built-in surplus heating tube is somewhat lower than the specific heating power to be measured in case of an upright channel having closed wall. Nevertheless, the convector of the invention ensures the following significant advantages. On the one hand, the bording side plates and the upper grid as well as their fastenings and structural elements necessary thereto are omitted. On the other hand, in case of identical building length, a higher heating power can be provided for in the room to be heated. Moreover, the rigid self-supporting structure built up of finned tubes can be simply suspended on hooks or provided with legs, while the front plate and if necessary the back plate can be fastened to this self-supporting structure. Due to this construction, the front plate can be quite easily replaced even after assembling the convector. Since the front plate is inexpensive as compared to the complete convector, the aesthetic apperance of the convector can be adjusted to the environment, and can be even modified by replacing the front plate.

With the convector according to the invention the chimney effect can be improved advantageously by such a construction in which the resistance to transverse air flow at the side finned tube or tubes is higher than the resistance to a transverse air flow at the lower finned tube. This may be achieved with transverse fin structures in such a way that at least a part of the side finned tubes have more closely-spaced fins than the fin structure of the lower finned tube.

In a preferred embodiment of the invention the second side bording element is a further side finned tube connected rigidly between ends of the lower and upper finned tubes thereby constituting a parallel path for the heating medium, said parallel path including a throttle element. In this case both side bording elements and the upper closing grid are constituted by heated finned tubes. However, in another embodiment the second side bording element can be a stiffening side plate attached rigidly to the lower and upper finned tubes.

With the convector according to the invention the air flow can be rendered more advantageous and thereby the heat output can be increased if in the inside of the upright channel oblique air deflector plates are arranged which are fastened either to the self-supporting structure or to the back plate or to the front plate.

It is very advantageous if the finned tubes are connected to each other by welding. It is highly expedient to use finned tubes having fin structures transverse to the axis of the respective tube. Such fin structure can consist of one or two band or wire folded in accordion-like shape and attached to the tube e.g. by welding so that the fin structure comprises fin sections substantially vertical to the axis of the respective tube. However, finned tubes provided with fin structures having round plates substantially vertical to the axis of the respective tube may also be used.

Such a construction may also be advantageous where the lower and upper finned tubes have fin structures transverse to the axis of the respective tube, whereas the side finned tubes have longitudinal fin structures consisting of plate fins welded to the tube along its generatrix and provided with perforations. The fin structures of the side and upper finned tubes should allow an air flow transverse to the longitudinal axis of the respective tube and should provide at the same time suitable closing and aesthetic appearance for the convector.

BRIEF DESCRIPTION OF THE DRAWINGS

The invention will be hereinafter described by way of preferred embodiments illustrated in the drawings, wherein.

MODES FOR CARRYING OUT THE INVENTION

In the figures the elements of identical or similar functions are indicated by the same reference numbers.

Figure 1:
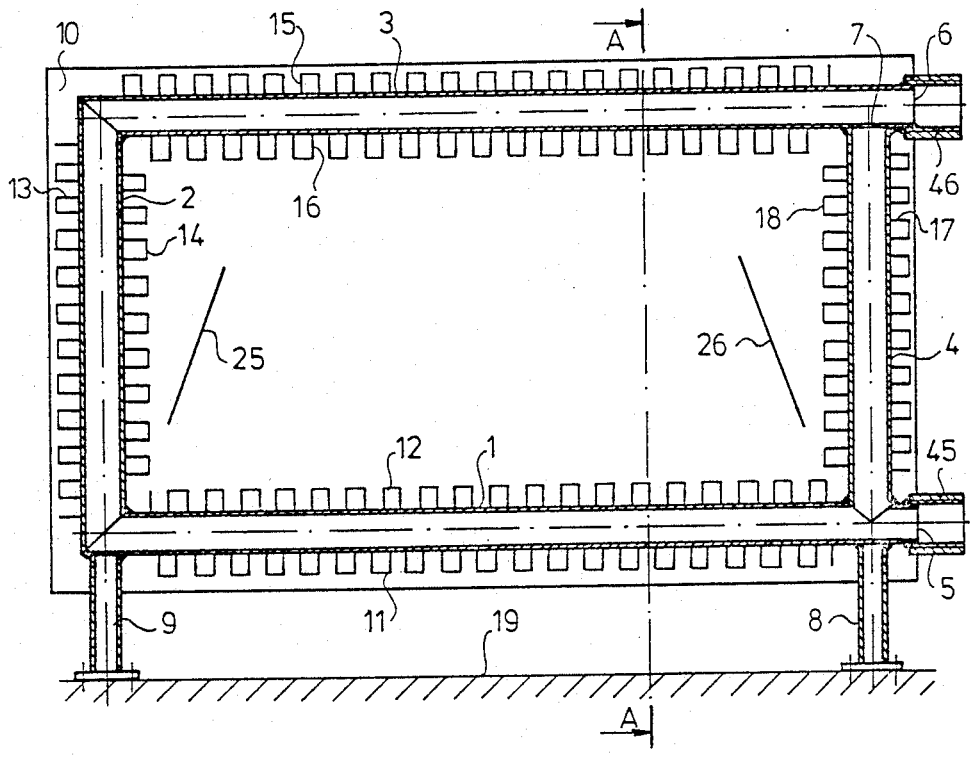
FIG. 1 is a longitudinal sectional view taken along the line B—B of FIG. 2 of an embodiment of the convector according to the invention.
Figure 2:
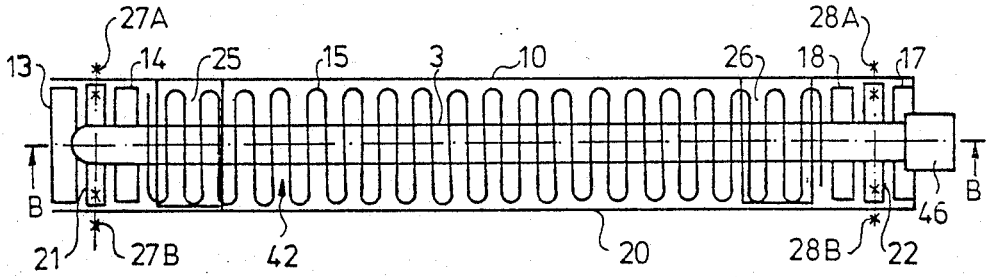
FIG. 2 is a top view of the convector according to FIG. 1.
Figure 3:
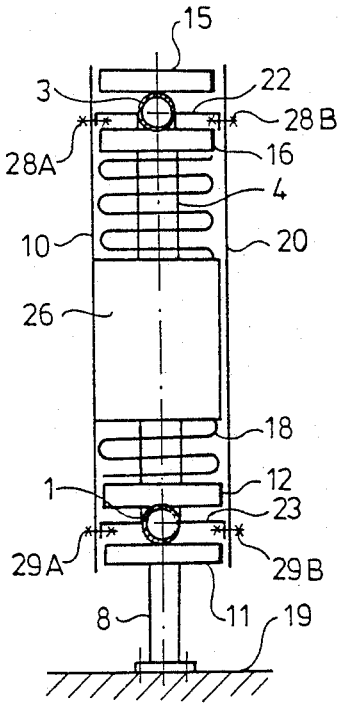
FIG. 3 is a sectional view taken along the line A—A of FIG. 1.

In FIGS. 1 to 3 the convector contains a self-supporting structure having a lower finned tube 1, two lateral finned tubes 2 and 4 and of an upper finned tube 3 welded together, to which structure legs 8 and 9 are welded, on which the convector stands on a floor 19. The finned tube 1 having fins 11 and 12 is provided with an inlet opening 5, the finned tube 3 having fins 15 and 16 is provided with an outlet opening 6. The inlet opening 5 and the outlet opening 6 are connected to a not shown pipe of a first heating medium, e.g. hot water by means of threaded connecting elements 45 and 46, respectively. The lateral finned tubes 2 and 4 have fins 13, 14 and 17, 18, respectively. The finned tubes 1, 2, 3 and 4 can also be constructed e.g. in the manner described in the Hungarian Pat. nos. 153,573 and 183,314.

The finned tubes 1, 2 and 3 are connected in series in respect of the heating medium. The finned tube 4 is connected in parallel and provided with a throttle element 7 in order to ensure the proper flow of the heating medium in the two parallel paths. The back plate 10 and the front plate 20 are fastened to the rigid self-supporting structure consisting of the finned tubes 1, 2, 3 and 4 by means of holding elements. Such holding elements 21, 22 and 23 are illustrated in FIGS. 2 and 3 which hold the back plate 10 and the front plate 20, respectively, by means of screw joints 27A, 28A, 29A and 27B, 28B, 29B, respectively.

The back plate 10, the front plate 20 and the finned tubes 2 and 4 define an upright channel 42 for a second medium, e.g. air in which oblique deflector plate 25 and 26 are arranged for developing a more advantageous air flow pattern. The deflector plates are fastened to the back plate 10 by welding in the embodiment shown in FIGS. 1–3.

Figure 4:
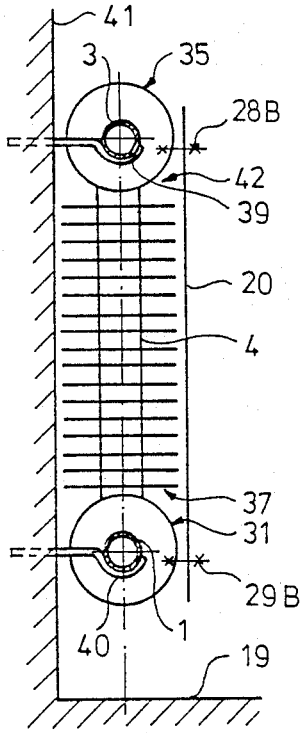
FIG. 4 is a sectional view of another embodiment of the convector according to the invention.

In FIG. 4 another embodiment is shown in a sectional view similar to FIG. 3. The finned tubes have fin structures consisting of round plates substantially vertical to the axis of the respective tube. In FIG. 4 only fin structures 31, 35 and 37 of finned tubes 1, 3 and 4 are to be seen. In this embodiment deflector plates 25 and 26 are not forseen and instead of having legs the self-supporting structure is suspended on the wall 41 by hooks from which hooks 39 and 40 are shown in the figure. So, there is no back plate, the back bording element for the upright channel 42 is the wall 41.

Figure 5:
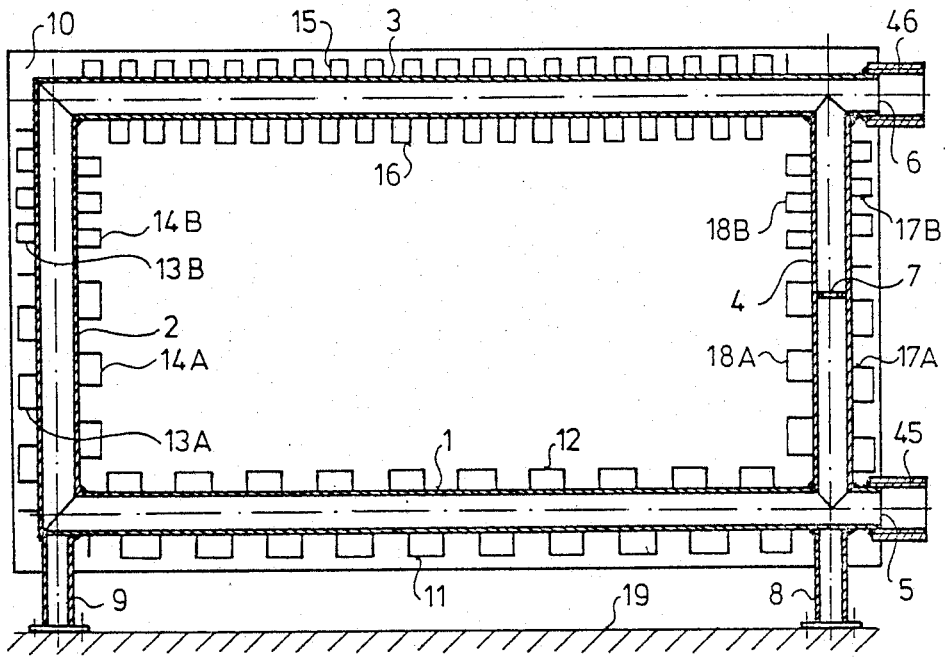
FIGS. 5 and 6 are longitudinal sectional views of two other embodiments.

The embodiment illustrated in FIG. 5 differs from that shown in FIG. 1 so far as the fin structures 15 and 16 of the upper finned tube 3 have more closely-spaced fins than the fin structures 11 and 12 of the lower finned tube 1, as well as in the lower section of the side finned tubes 2 and 4 the fin structures 13A, 14A and 17A, 18A, respectively, have fins identically spaced with the fin structures 11 and 12, whereas in the upper section of the side finned tubes 2 and 4 the fin structures 13B, 14B and 17B, 18B, respectively, have fins identically spaced with the fin structures 15 and 16. Thereby an air flow picture more advantageous in respect of the heat transfer is attainable. The side finned tubes 2 and 4 can expediently be welded from two pieces corresponding to the different fin structures, the throttle element 7 may be made before the welding.

Figure 6:
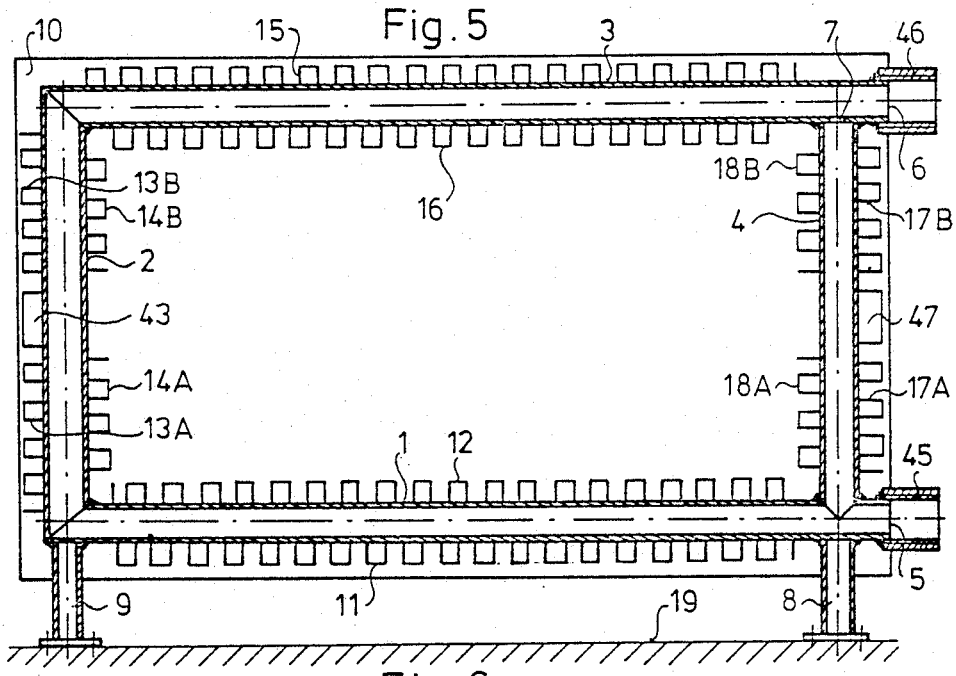

The embodiment shown in FIG. 6 differs from that shown in FIG. 1 so far as the fin structures of the side finned tube 2 and 4 are not uniform along the tubes. They consist of three parts, of the transversal fin structures 13A, 14A and 13B, 14B and 17A, 18A and 17B, 18B, respectively, as well as of the longitudinal fin structures 43 and 47 arranged between them. The fin structure 43 and 47 have plate pieces fastened to the tube so that only beneath and above the plate pieces can the air flow in transversal direction through the finned tubes 2 and 4. This embodiment also offers an advantageous air flow picture.

Figure 7:
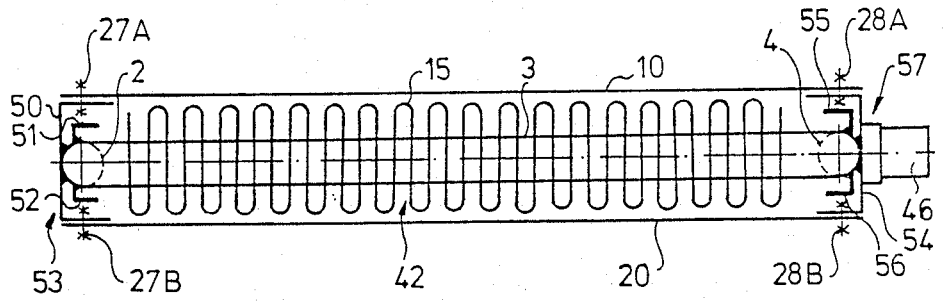
FIG. 7 is a top view of another embodiment of the invention.
Figure 8:
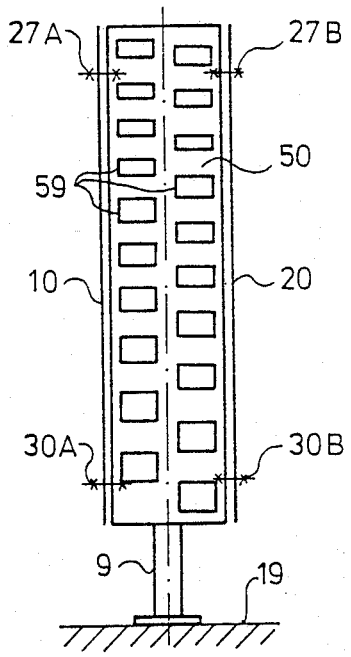
FIG. 8 is a side view of the embodiment according to FIG. 7.

In the embodiment shown in FIG. 7 in top view, similar to that of FIG. 2, and FIG. 8 in side view, the upper finned tube 3 and the lower finned tube—the latter is not shown in the figures—are provided with transversal fin structures similar to FIGS. 1 and 2, from which only the fin structure 15 is visible in FIG. 7. The fin structures 53 and 57 of the side finned tubes 2 and 4, respectively, consist of longitudinal plate fins welded long generatrices to the respective tube. The outer plate fins 50 and 54 act as side bording elements for the upright channel 42 and are provided with perforations 59. These plate fins 50 and 54 hold at the same time the back plate 10 and the front plate 20 by means of screw joints. In the figures only screw joints 27A, 27B, 28A, 28B, 30A and 30B are to be seen. The size and spacing of the perforations 59 are chosen for attaining an advantageous air flow picture within the upright channel 42. The fin structures 53 and 57 can also have inner plate fins 51, 52 and 55, 56, respectively, which are welded to the respective tube.

Figure 9:
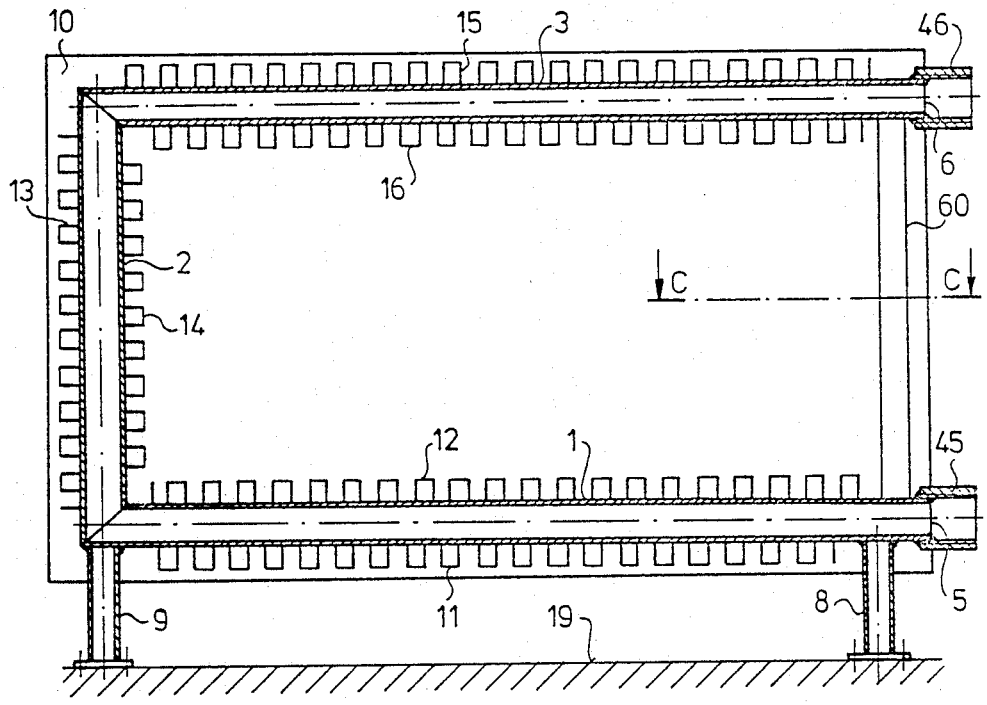
FIG. 9 is a longitudinal sectional view of a further embodiment of the convector according to the invention.
Figure 10:
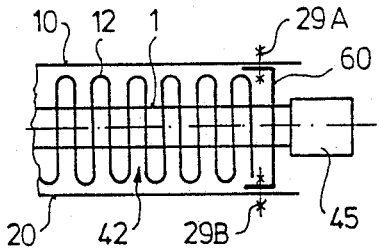
FIG. 10 is a part of a sectional view taken along the line C—C of FIG. 9.

In the embodiment shown in FIGS. 9 and 10 only three rigidly series-connected finned tubes 1, 2 and 3 are arranged. Between the end towards the inlet opening 5 of the finned tube 1 and the end towards the outlet opening 6 of the finned tube 3 a stiffening side plate 60 is welded to the finned tubes 1 and 3. The side plate 60 constitutes on this side the bording element for the upright channel 42 and, at the same time, it stiffens the self-supporting structure consisting of the finned tubes 1, 2 and 3. It is to be seen in FIG. 10 that on this side, the back plate 10 and the front plate 20 are directly fastened to the side plate 60 by means of screw joints 29A and 29B.

A convector according to the invention can be different from the embodiments illustrated in the figures. The tubes provided with fins can have not only circular but also any other, e.g. rectangular cross-section and also the fins can be of another form. The lower finned tube of the convector which participates in the heat transfer with the highest efficiency and cannot be seen from outside can have fins different from the other fins visible from outside and also performing also a bording task. An embodiment can also be advantageous in which two lower finned tubes are connected in parallel for the heating medium. The heat release capacity of the convector can be increased without the increase of the building length in such a way that two or more rigid self-supporting structures, each containing finned tubes 1, 2, 3 and 4, are arranged side by side, fastened to each other by fixing means for keeping a given distance between the adjacent structures and in respect of the heating medium connected in parallel or in series. In the case of two or more self-supporting structures according to FIG. 9, a common stiffening side plate 60 can be used.

What is claimed:

1. A convector for heat exchange between a hot first medium and second medium to be heated, comprising a substantially horizontal lower finned tube, one end of which is provided with a first opening for the first medium; a substantially vertical lateral finned tube connected to the other end of said lower finned tube, said lateral finned tube constituting a first lateral ording element for an upright channel for the second medium; a substantially horizontal upper finned tube constituting an upper closure for an upright channel, one end of said upper finned tube being connected to the upper end of said lateral finned tube, the other end of said upper finned tube being provided with a second opening for the first medium; said lower lateral and upper finned tubes having accordion-like fins comprising fin sections substantially perpendicular to the axis of the like respective tubes; and said lower, lateral, and upper finned tubes constituting a path for the first medium between said first and second opening; a second lateral bording element for the upright channel, said second lateral bording element being disposed between said one end of the lower finned tube and said other end of said upper finned tube so that said lower, lateral, and upper finned tubes and said second lateral bording element constitute a self-supporting structure; and a bording front plate for the upright channel, fastened to that self-supporting structure.

2. The convector of claim 1, wherein said second lateral bording element is a further lateral finned tube having accordion-like fins comprising fin sections substantially perpendicular to the axis of said further lateral finned tube, said further lateral finned tube being connected rigidly to said one end of the lower finned tube and to said other end of the upper finned tube, thereby constituting a parallel path for the first medium, said parallel path included a throttle element.

3. The convector of claim 1, further comprising legs connected rigidly to said self-supporting structure.

4. The convector of claim 1, further comprising bording back plate fastened to self-supporting structure.

5. The convector of claim 4, further comprising oblique deflector plates for the second medium in the upright channel, said deflector plates being fastened to the back plate.

6. The convector of claim 1, wherein said finned tubes are connected to each other by welding.

7. The convector of claim 1, wherein said first opening is an inlet opening, and said second opening is an outlet opening for the first medum.

* * * * *